US011168634B2

(12) United States Patent
Stutika et al.

(10) Patent No.: US 11,168,634 B2
(45) Date of Patent: Nov. 9, 2021

(54) OPERATION OF A FUEL INJECTOR WITH HYDRAULIC STOPPING

(71) Applicant: CPT Group GmbH, Hannover (DE)

(72) Inventors: Markus Stutika, Regensburg (DE); Gerd Rösel, Regensburg (DE)

(73) Assignee: VITESCO TECHNOLOGIES GMBH, Hanover (DE)

( * ) Notice: Subject to any disclaimer, the term of this patent is extended or adjusted under 35 U.S.C. 154(b) by 406 days.

(21) Appl. No.: 16/338,888

(22) PCT Filed: Sep. 18, 2017

(86) PCT No.: PCT/EP2017/073514
§ 371 (c)(1),
(2) Date: Apr. 2, 2019

(87) PCT Pub. No.: WO2018/068998
PCT Pub. Date: Apr. 19, 2018

(65) Prior Publication Data

US 2021/0293194 A1 Sep. 23, 2021

(30) Foreign Application Priority Data

Oct. 12, 2016 (DE) ..... 10 2016 219 881.5

(51) Int. Cl.
*F02D 41/20* (2006.01)
*F02M 51/06* (2006.01)

(52) U.S. Cl.
CPC ..... *F02D 41/20* (2013.01); *F02M 51/0625* (2013.01); *F02D 2041/2017* (2013.01);
(Continued)

(58) Field of Classification Search
CPC ..... F02D 41/20; F02D 2041/2017; F02D 2041/2051; F02M 51/0625; F02M 2200/304
(Continued)

(56) References Cited

U.S. PATENT DOCUMENTS 6,128,175 A 10/2000 Wright et al. ..... 361/154
6,189,815 B1 2/2001 Potschin et al. ..... 239/533.2
(Continued)

FOREIGN PATENT DOCUMENTS

CN 101818699 A 9/2010 ..... F02D 41/22
CN 102076950 A 5/2011 ..... F02M 47/02
(Continued)

OTHER PUBLICATIONS

German Office Action, Application No. 102016219881.5, 5 pages, dated May 31, 2017.
(Continued)

*Primary Examiner* — Hai H Huynh
(74) *Attorney, Agent, or Firm* — Slayden Grubert Beard PLLC

(57) ABSTRACT

Various embodiments include a method for operating a fuel injector having a hydraulic stop comprising: applying a first current profile to a solenoid drive to inject a predetermined injection quantity; ascertaining a first value of a parameter correlating to a velocity of the armature when reaching the hydraulic stop; determining whether the first value of the parameter is greater than a first threshold value; and if the first value of the parameter is greater than the first threshold value, applying a second current profile to the solenoid drive to carry out a second injection procedure. The second current profile in comparison with the first current profile exerts a lower magnetic force in the direction of the pole piece on the armature.

10 Claims, 4 Drawing Sheets

(52) U.S. Cl.
CPC ..... *F02D 2041/2051* (2013.01); *F02M 2200/304* (2013.01)

(58) Field of Classification Search
USPC ..... 123/472, 490, 478, 480, 482, 486; 701/103–105
See application file for complete search history.

(56) References Cited

U.S. PATENT DOCUMENTS

| | | | | |
|---|---|---|---|---|
| 6,431,155 | B1 | 8/2002 | Yamakado et al. | 123/490 |
| 6,712,048 | B2 | 3/2004 | Aoki et al. | 123/490 |
| 6,785,112 | B2 | 8/2004 | Reischl et al. | 361/154 |
| 7,849,836 | B2 | 12/2010 | Chang | 123/456 |
| 7,856,867 | B2 | 12/2010 | Lucido et al. | 73/114.45 |
| 9,201,427 | B2 | 12/2015 | Kraft et al. | |
| 9,840,993 | B2 | 12/2017 | Ikemoto et al. | |
| 9,970,376 | B2 | 5/2018 | Nagatomo et al. | |
| 10,041,430 | B2 | 8/2018 | Syed et al. | |
| 10,100,769 | B2 | 10/2018 | Maase et al. | |
| 2014/0312147 | A1 | 10/2014 | Petrecchia et al. | 239/585.5 |
| 2016/0053731 | A1 | 2/2016 | Mechi | 239/585.5 |
| 2018/0156153 | A1 | 6/2018 | Denk | |
| 2018/0163657 | A1 | 6/2018 | Hauser et al. | |

FOREIGN PATENT DOCUMENTS

| | | | | |
|---|---|---|---|---|
| CN | 102177332 | A | 9/2011 | F02M 51/06 |
| CN | 104575933 | A | 4/2015 | H01F 7/18 |
| DE | 19828672 | A1 | 1/1999 | F02D 41/20 |
| DE | 19826794 | A1 | 12/1999 | F02M 45/08 |
| DE | 10014228 | A1 | 9/2001 | F02D 41/02 |
| DE | 10217608 | A1 | 12/2002 | F02D 41/20 |
| DE | 102008041595 | A1 | 3/2010 | F02M 47/02 |
| DE | 102011007579 | A1 | 10/2012 | F02D 41/20 |
| DE | 102011075269 | B4 | 3/2014 | F02D 41/20 |
| DE | 102015104009 | A1 | 9/2015 | F02D 41/20 |
| DE | 102015118416 | A1 | 5/2016 | F02D 41/38 |
| DE | 112014004229 | T5 | 5/2016 | F02D 41/00 |
| DE | 102015208573 | B3 | 6/2016 | F02D 41/20 |
| DE | 102015210794 | B3 | 7/2016 | F02D 41/20 |
| DE | 112014005317 | T5 | 8/2016 | F02D 41/20 |
| EP | 1344903 | A2 | 9/2003 | F01L 9/04 |
| JP | 2007100650 | A | 4/2007 | F02M 51/06 |
| JP | 5994756 | B2 | 9/2016 | F02D 41/20 |
| WO | 2011/143552 | A2 | 11/2011 | F02M 51/06 |
| WO | 2018/068998 | A1 | 4/2018 | F02D 41/20 |
| WO | 2018/069041 | A1 | 4/2018 | F02D 41/20 |

OTHER PUBLICATIONS

German Office Action, Application No. 102016219888.2, 5 pages, dated Jun. 1, 2017.
International Search Report and Written Opinion, Application No. PCT/EP2017/073514, 16 pages, dated Dec. 11, 2017.
International Search Report and Written Opinion, Application No. PCT/EP2017/074443, 17 pages, dated Jan. 17, 2018.
Chinese Office Action, Application No. 201780063423.X, 13 pages, dated Apr. 16, 2021.
Korean Notice of Allowance, Application No. 2020049221972, 3 pages, dated Jul. 20, 2020.

OPERATION OF A FUEL INJECTOR WITH HYDRAULIC STOPPING

CROSS-REFERENCE TO RELATED APPLICATIONS

This application is a U.S. National Stage Application of International Application No. PCT/EP2017/073514 filed Sep. 18, 2017, which designates the United States of America, and claims priority to DE Application No. 10 2016 219 881.5 filed Oct. 12, 2016, the contents of which are hereby incorporated by reference in their entirety.

TECHNICAL FIELD

The present disclosure relates to fuel injectors. Various embodiments of the teachings herein include methods of operating fuel injectors having a hydraulic stop.

BACKGROUND

In the case of fuel injectors having a so-called hydraulic stop, no direct contact between the armature and the pole piece arises when the fuel injector opens, since the fuel flows between the armature and the pole piece, and herein exerts a hydraulic force, counter to the magnetic force, on the armature. Said two forces cancel each other out in the open state of the fuel injector, so that a gap having a substantially constant width is present between the armature and the pole piece. However, in the case of the hydraulic force being too low, for example in the case of a defective fuel pump (high-pressure pump), the necessary gap width cannot be maintained and the injection of fuel, by virtue of the correspondingly high drop in pressure in the small gap (or in the closed gap, in a worst-case scenario), is blocked after a very short time.

SUMMARY

The present disclosure describes methods and systems for operating a fuel injector having a hydraulic stop such that the above problems in the case of a reduced fuel pressure can be avoided or counteracted, respectively. For example, some embodiments include a method for operating a fuel injector (1) having an hydraulic stop, wherein the fuel injector (1) has a solenoid drive and a pole piece (6), wherein the solenoid drive has a movable armature (4) and a nozzle needle (5) that is movable by way of the armature (4), the method comprising the steps of: impinging (510) the solenoid drive of the fuel injector (1) with a first current profile, so as to carry out a first injection procedure and, on account thereof, to inject a predetermined injection quantity; ascertaining (520) a first value of a parameter which is indicative of a velocity (v) of the armature (4) when hydraulically stopped; determining (530) whether the first value of the parameter is greater than a first threshold value (S1); and having determined that the first value of the parameter is greater than the first threshold value (S1), impinging (535) the solenoid drive of the fuel injector (1) with a second current profile, so as to carry out a second injection procedure; wherein the second current profile in comparison with the first current profile is specified such that a lower magnetic force in the direction of the pole piece (6) is exerted on the armature (4).

In some embodiments, the parameter is determined based on a feedback signal which is used for determining an opening temporal point for the fuel injector.

In some embodiments, the first current profile has a first peak current value, and the second current profile has a second peak current value, and wherein the second peak current value is smaller than the first peak current value.

In some embodiments, the first current profile has a first holding current value, and the second current profile has a second holding current value, and wherein the second holding current value is smaller than the first holding current value.

In some embodiments, the first current profile is impinged by means of at least one first voltage pulse, and the second voltage profile is impinged by means of at least one second voltage pulse, and wherein the second current pulse has a lower voltage than the first voltage pulse.

In some embodiments, the method also comprises: having determined that the first value of the parameter is not greater than the first threshold value (S1), determining (540) whether the first value of the parameter is smaller than a second threshold value (S2); and having determined that the first value of the parameter is smaller than the second threshold value (S2), impinging (535) the solenoid drive of the fuel injector (1) with a second current profile, so as to carry out a second injection procedure; wherein the second current profile in comparison with the first current profile is specified such that a greater magnetic force in the direction of the pole piece (6) is exerted on the armature (4).

In some embodiments, the method also comprises: ascertaining (520) a second value of the parameter; determining (530) whether the second value of the parameter is greater than the first threshold value (S1); and having determined that the second value of the parameter is greater than the first threshold value (S1), impinging (535) the solenoid drive of the fuel injector with a third current profile, so as to carry out a third injection procedure; wherein the third current profile in comparison with the second current profile is specified such that a lower magnetic force in the direction of the pole piece (6) is exerted on the armature (4).

In some embodiments, the method also comprises: having determined that the second value of the parameter is not greater than the first threshold value (S1), determining (540) whether the second value of the parameter is smaller than a second threshold value (S2); and having determined that the second value of the parameter is smaller than the second threshold value (S2), impinging (535) the solenoid drive of the fuel injector (1) with a third current profile, so as to carry out a third injection procedure; wherein the third current profile in comparison with the second current profile is specified such that a greater magnetic force in the direction of the pole piece (6) is exerted on the armature (4).

As another example, some embodiments include an engine control unit for a vehicle, said engine control unit being specified for using methods as described above.

As another example, some embodiments include a computer program which, when executed by a processor, is specified for carrying out the methods as described above.

BRIEF DESCRIPTION OF THE DRAWINGS

Further advantages and features of various embodiments of the present teachings are derived from the exemplary description hereunder of an example embodiment. In the figures.

DETAILED DESCRIPTION

Figure 1:
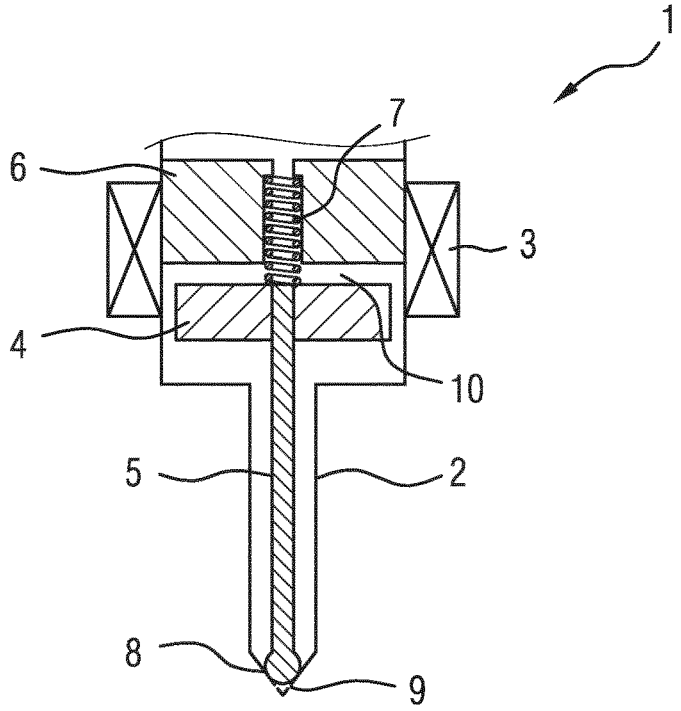
FIG. 1 shows a fuel injector having a hydraulic stop in a closed state.

In some embodiments, a method for operating a fuel injector having a hydraulic stop, a solenoid drive, and a pole piece, and the solenoid drive has a movable armature and a nozzle needle that is movable by way of the armature comprises the following steps: (a) impinging the solenoid drive of the fuel injector with a first current profile, so as to carry out a first injection procedure and, on account thereof, to inject a predetermined injection quantity; (b) ascertaining a first value of a parameter which is indicative of a velocity of the armature when hydraulically stopped; (c) determining whether the first value of the parameter is greater than a first threshold value, and (d) having determined that the first value of the parameter is greater than the first threshold value, impinging the solenoid drive of the fuel injector with a second current profile, so as to carry out a second injection procedure, wherein the second current profile in comparison with the first current profile is specified such that a lower magnetic force in the direction of the pole piece is exerted on the armature (in order for a larger gap to be created between the pole piece and the armature).

In some embodiments, the lower the hydraulic force (relative to the magnetic force), the higher the velocity of the armature when impacting the hydraulic stop, that is to say at which the armature is decelerated by the counter-acting hydraulic force. This can be traced back to the armature in the case of a comparatively low hydraulic force (by virtue of the smaller gap between the armature and the pole piece) travelling a greater distance and thus achieving a higher velocity. A maximum velocity is achieved in particular when there is no gap present, that is to say that the armature impacts directly the pole piece. By evaluating a parameter value which is indicative of the armature velocity when hydraulically stopped, it can consequently be ascertained whether the hydraulic stop takes place as expected, thus leading to an appropriate with of the gap between the armature and the pole piece, or whether there is a mismatch between the magnetic force and the hydraulic force. In the latter case, the width of the gap will be too small or equal to zero, such that no fuel flow can take place through the injector after the latter has opened. This can then be counteracted by a second (adapted) current profile, in that the second current profile is specified such that a lower magnetic force is generated.

In this document a "fuel injector having a hydraulic stop" refers to a fuel injector in which the fuel flows through a gap between the armature and the pole piece. The "hydraulic stop" is created on account of this volumetric flow, said hydraulic stop decelerating the armature movement in the direction of the pole piece toward the end of an opening procedure.

In this document, "current profile" refers to a predetermined temporal profile (for example implemented by closed-loop controlling) of the current intensity of the current running through the solenoid of the solenoid drive during an actuating process.

In some embodiments, a method begins with an injection process in which the solenoid drive is loaded with a first current profile which is designed to achieve an injection of a predetermined injection quantity on the assumption of a specific fuel pressure (for example a fuel pressure that is normal for operation, or that is already reduced in response to the detection of a fault). In other words, the first current profile is provided for the expected (for example, normal) operation (for example, without a reduced fuel pressure). In conjunction with this actuation, a first value of a parameter is then ascertained and it is determined whether said first value, which is indicative of the velocity of the armature when hydraulically stopped, is greater than a first (upper) threshold value. If this is the case, there is a disparity between the magnetic force and the hydraulic force. This would be the case in particular if the fuel pressure is reduced, for example because of a defective high-pressure pump, i.e. is substantially lower than the usual (or expected) fuel pressure.

Having determined that the first value of the parameter is greater than the first threshold value, the solenoid drive is then impinged with a second current profile which differs from the first current profile in that a lower magnetic force in the direction of the pole piece is now exerted on the armature. Because of the smaller magnetic force, the equilibrium between the magnetic force and the hydraulic force is created at a larger gap between the armature and the pole piece than when actuated by way of the first current profile. A larger volumetric flow can thus flow through the gap and a larger actually injected fuel quantity can ultimately be achieved, said larger actually injected fuel quantity being closer to the predetermined fuel quantity. In other words, correct functioning of the fuel injector can be achieved. Precise closed-loop controlling of the injected fuel quantity can and should then be performed by other methods known per se.

In some embodiments, the parameter is determined based on a feedback signal which is used for determining an opening temporal point for the fuel injector. The feedback signal has a temporal profile of a current that is induced in the solenoid by virtue of the armature movement, or of the corresponding coil voltage. Such a feedback signal can be used in a manner known for determining opening (OPP2) and closing times (OPP4). The feedback signal can be determined and evaluated, for example, by subtracting a detected current or voltage profile and a reference profile, or by a temporal derivation or a formation of gradients.

In some embodiments, the first current profile has a first peak current value, and the second current profile has a second peak current value, wherein the second peak current value is smaller than the first peak current value. In this document, "peak current value" refers to the value of the current intensity at which a voltage pulse is terminated at the beginning of an actuating procedure. At a smaller peak current value in the second current profile, the maximal magnetic force on the armature in the direction of the pole piece is thus also smaller than when the first current profile is used.

In some embodiments, the first current profile has a first holding current value, and the second current profile has a second holding current value, wherein the second holding current value is smaller than the first holding current value. In this document, "holding current value" refers to the value of the current intensity which is set for keeping the opened fuel injector open during the injection. At a smaller holding current value in the second current profile, the maximum magnetic force in the direction of the pole piece on the armature during the injection is thus also lower than in the use of the first current profile.

In some embodiments, the first current profile is applied by means of at least one first voltage pulse, and the second current profile is applied by means of at least one second voltage pulse, wherein the second voltage pulse has a lower voltage than the first voltage pulse. On account of the use of a lower voltage for the generation of the second current profile, the current intensity (and thus the magnetic force) increases less rapidly than in conjunction with the first current profile.

In some embodiments, the method also comprises the following: (a) having determined that the first value of the parameter is not greater than the first threshold value, determining whether the first value of the parameter is smaller than a second threshold value; and (b) having determined that the first value of the parameter is smaller than the second threshold value, impinging the solenoid drive of the fuel injector with a second current profile, so as to carry out a second injection procedure, wherein the second current profile in comparison with the first current profile is specified such that a greater magnetic force in the direction of the pole piece is exerted on the armature.

In other words, it is determined whether the first value of the parameter is smaller than a second (lower) threshold value, that is to say that the armature velocity is so low that expedient opening of the fuel injector is not guaranteed by virtue of the magnetic force being excessively low (in comparison with the hydraulic force). In this case, the second (adapted) current profile is specified such that a greater magnetic force is generated (other than in conjunction with the first threshold value).

In some embodiments, the method also comprises the following: (a) ascertaining a second value of the parameter; (b) determining whether the second value of the parameter is greater than the first threshold value; and (c) having determined that the second value of the parameter is greater than the first threshold value, impinging the solenoid drive of the fuel injector with a third current profile, so as to carry out a third injection procedure, wherein the third current profile in comparison with the second current profile is specified such that a lower magnetic force in the direction of the pole piece is exerted on the armature.

In some embodiments, a second value of the parameter (corresponding to the actuation by way of the second current profile) is ascertained, and it is determined whether the second value is smaller than the first (upper) threshold value. In other words, it is checked whether the second current profile leads to a correct injection in the sense that the fuel injector is functioning according to the intended purpose. If this is not the case, the solenoid drive is then loaded with a third current profile which differs from the second current profile in that an even lower magnetic force is now exerted on the armature in the direction of the pole piece. By virtue of the lower magnetic force, the equilibrium between the magnetic force and the hydraulic force is created at a larger gap between the armature and the pole piece than when actuated by way of the second (and first) current profile. An (even) larger volumetric flow can thus flow through the gap and a larger actually injected fuel quantity can ultimately be achieved, said larger actually injected fuel quantity being closer to the predetermined fuel quantity. The method steps can be repeated until it is no longer determined that the value of the parameter is greater than the first threshold value, that is to say so often such that correct functioning of the fuel injector is ensured.

In some embodiments, the method also comprises the following: (a) having determined that the second value of the parameter is not greater than the first threshold value, determining whether the second value of the parameter is smaller than a second threshold value; and (b) having determined that the second value of the parameter is smaller than the second threshold value, impinging the solenoid drive of the fuel injector with a third current profile, so as to carry out a third injection procedure, wherein the third current profile in comparison with the second current profile is specified such that a greater magnetic force in the direction of the pole piece is exerted on the armature.

In other words, it is determined whether the second value of the parameter is smaller than a second (lower) threshold value, that is to say that the armature velocity is so low that expedient opening of the fuel injector is not guaranteed by virtue of the magnetic force being excessively low (in comparison with the hydraulic force). In this case, the third (adapted) current profile is specified such that a greater magnetic force is generated (other than in conjunction with the first threshold value).

In some embodiments, an engine control unit for a vehicle is designed to use a method according to the first aspect and/or one of the above embodiments. This engine control unit enables in a simple manner, in particular by modifying a current profile as a function of a value of a parameter, that malfunctioning of a fuel injector having a hydraulic stop by virtue of a reduced fuel pressure can be counteracted and alleviated.

In some embodiments, a computer program which, when it is executed by a processor, is designed to carry out the method according to the first aspect and/or one of the above embodiments. Within the meaning of this document, the designation of a computer program of this kind is equivalent to the concept of a program element, a computer program product and/or a computer-readable medium which contains instructions for controlling a computer system, in order to coordinate the manner of operation of a system or of a method in a suitable manner, in order to achieve the effects associated with the methods described herein.

The computer program can be implemented as a computer-readable instruction code in any suitable programming language, such as in JAVA, C++ etc. for example. The computer program can be stored on a computer-readable storage medium (CD-ROM, DVD, Blu-ray disk, removable drive, volatile or non-volatile memory, integral memory/processor etc.). The instruction code can program a computer or other programmable devices, such as in particular a control unit for an engine of a motor vehicle, in such a way that the desired functions are executed. Furthermore, the computer program can be provided in a network such as, for example, the Internet, from which a user can download it as required. The methods can be realized both by means of a computer program, i.e. software, and also by means of one or more specific electrical circuits, i.e. as hardware or in any desired hybrid form, i.e. by means of software components and hardware components.

It should be noted that various embodiments have been described with reference to different subjects. In particular, some embodiments are described by way of methods and other embodiments are described by way of device. However, it will become immediately clear to a person skilled in the art on reading this application that, unless explicitly stated otherwise, in addition to a combination of features which are associated with one type of subject matter of the disclosure, any combination of features which are associated with different types of embodiments is also possible. The embodiments described hereunder are merely a limited selection of potential variant embodiments.

FIG. 1 shows a fuel injector 1 having a hydraulic stop in a closed state. The fuel injector 1 has a housing 2, a coil 3, a movable armature 4, a nozzle needle 5 which is or can be mechanically coupled (for example via a driver) to the armature, a pole piece 6, and a calibration spring 7. In the state depicted in FIG. 1, the valve needle rests in the valve seat 8 and therefore blocks the injection bores 9. In this state, the gap 10 between the armature 4 and the pole piece consequently has a maximal width.

Figure 2:
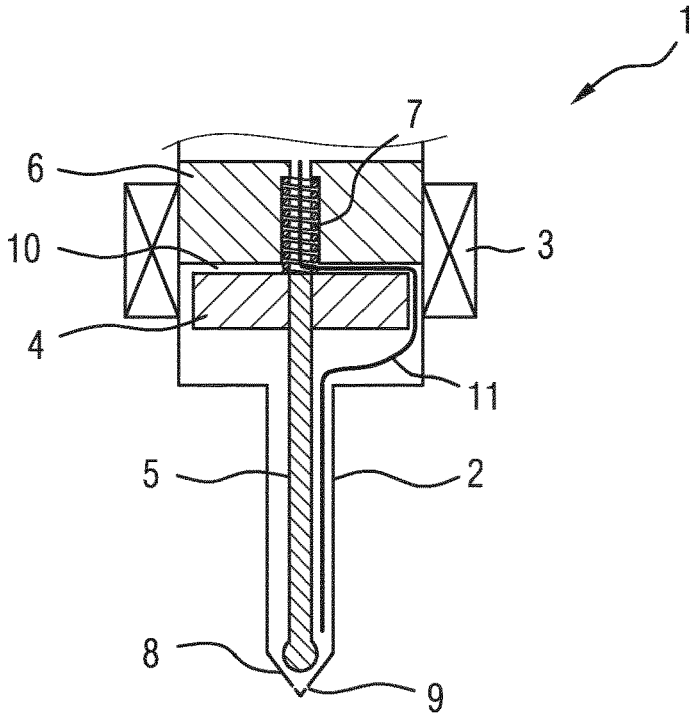
FIG. 2 shows the fuel injector shown in FIG. 1 in an opened state.

When a voltage is applied to the coil 3, the armature 4 is moved in the direction of the pole piece 6 by electromagnetic forces. Owing to mechanical coupling, the nozzle needle 5 likewise moves and releases the injection bores 9 for the supply of fuel. In the case of fuel injectors with an idle stroke, the mechanical coupling between the armature 4 and the nozzle needle 5 only takes place when the armature 4 has overcome the idle stroke. In the case of fuel injectors without an idle stroke, the needle movement begins at the same time as the armature movement. This state is shown in FIG. 2. As can be derived from FIG. 2, the gap 10 between the armature 4 and the pole piece 6 is now considerably smaller than in FIG. 1, and the nozzle needle 5 is accordingly positioned at a distance from the valve seat 8. There is now a path for the fuel flow 11 within the fuel injector 1. The volumetric flow 11 has to flow through the gap 10 between the armature and the pole piece 6, and laterally bypass the armature 4 to reach the injection bores 9.

This results in a drop in pressure across the armature 4, which generates a (hydraulic) force countering the magnetic force. The smaller the gap 10, the greater the drop in pressure and therefore the higher the force in the closing direction. The armature 4 therefore moves in the direction of the pole piece 6 until the force, on account of the pressure drop, is at the equilibrium with the magnetic force. If this is the case, the upper stop is reached, so to speak. However, there is no contact between the armature 4 and the pole piece 6, but rather the hydraulic stop is produced by the volumetric flow 11.

Figure 3:
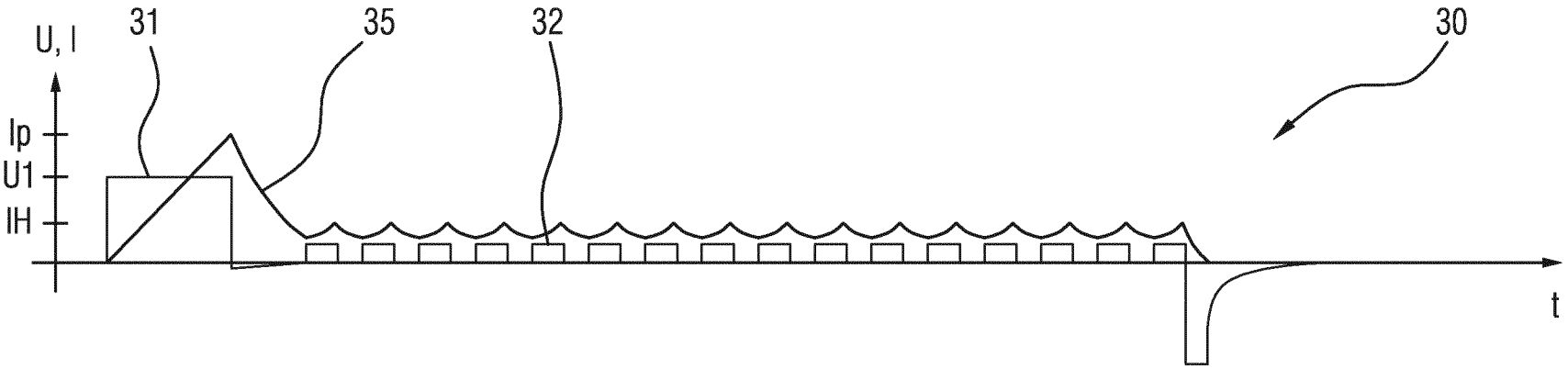
FIG. 3 shows temporal profiles of the voltage and current intensity in a conventional operation of a fuel injector having a hydraulic stop.

The diagram 30 in FIG. 3 shows temporal profiles of voltage (U) 31, 32 and current intensity (I) 35 in the case of conventional operation of the fuel injector 1. Driving begins with a boost phase in which a voltage pulse 31 with voltage U1 (boost voltage) is applied to the solenoid drive 3 in order to move the armature 4 and the nozzle needle from the state in FIG. 1 to the state in FIG. 2. The voltage pulse 31 ends when the current intensity 35 reaches a predetermined maximal value (peak current) IP. Thereafter, a somewhat lower coil current IH (also referred to as holding current) is maintained for the duration of the injection operation by applying a series of relatively small voltage pulses 32 to the solenoid drive 3, so that the fuel injector 1 remains open, that is to say remains in the state shown in FIG. 2. Here, the holding current IH refers to the mean current value which is produced by switching on and switching off in accordance with the current pulses 32. This mean current IH leads to a corresponding mean magnetic force. Owing to the inertia, the mechanism does not react to switching on and switching off, and therefore the voltage pulses 32 do not cause any armature movement.

In the case of an unfavourable ratio between the magnetic force and the hydraulic force due to a drop in pressure, it may be the case that, owing to a current which is selected to be too high (and therefore an excessively high magnetic force), the gap 10 between the armature 4 and the pole piece 6 is closed or the drop in pressure is so great that there is no longer any volumetric flow available for the injection process. This situation may occur in a vehicle, for example, in the event of failure of the high-pressure pump (so-called low-pressure limp home). Therefore, only the preliminary delivery pressure (up to approximately 10 bar) is still available. The injector 1 is typically designed for operation at substantially higher pressures and therefore the design of the magnetic circuit is too powerful for operation at 5 to 10 bar.

Figure 4:
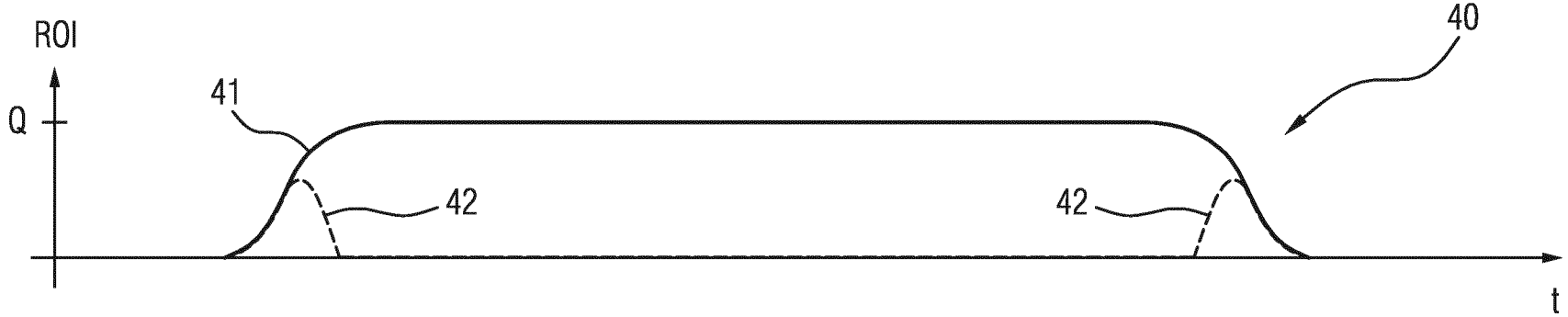
FIG. 4 shows respective temporal profiles of the injection rate of a fuel injector having a hydraulic stop in the case of a conventional operation in a normal operating state, and in an operating state with a disparity between the magnetic force and the hydraulic force, for example by virtue of a reduced fuel pressure and an excessively high magnetic force.

The diagram 40 in FIG. 4 shows the respective temporal profiles 41 and 42 of the injection rate ROI in the case of conventional operation (i.e. with the actuation shown in FIG. 3) of the fuel injector 1 in a normal operating state (at normal fuel pressure) and in an operating state with reduced fuel pressure. The time profile 41 corresponds to the normal state in which the injection rate ROI increases approximately starting from the end of the boost phase until the maximum rate Q is reached and then drops again only at the end of the actuation. By contrast, the temporal profile 42 corresponds to the state with a reduced fuel pressure. Here, the injection rate also rises briefly, but drops again before the maximum rate Q is reached and remains at zero until shortly before the end of actuation, since the gap 10, on account of the high magnetic force relative to the hydraulic force, is closed or is so small that the pressure drop in the gap becomes excessive. The gap 10 is briefly opened, or becomes sufficiently large, respectively, to allow a volumetric flow to pass through again only when the magnetic force has again dropped after the holding current IH is switched off (cf. FIG. 3). At the end of the closing procedure, the injection bores 9 are closed by the nozzle needle 5, and the width of the gap 10 is at a maximum. Therefore, in this case, considerably less fuel is injected overall and further travel is almost impossible because the required quantity of fuel cannot be delivered.

Figure 5:
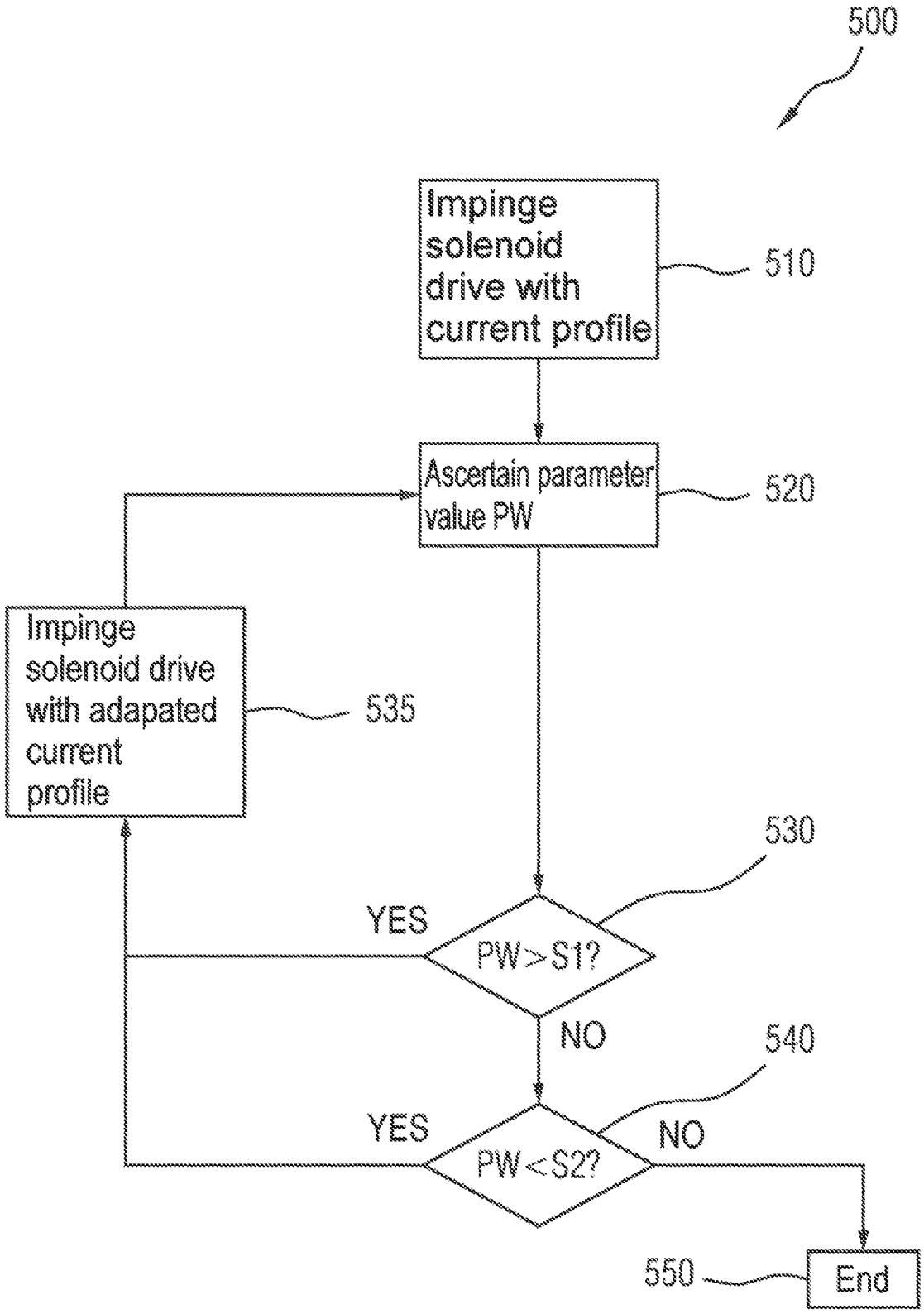
FIG. 5 shows a flowchart of a method incorporating teachings of the present disclosure.

FIG. 5 shows a flowchart 500 of a method according to the invention for solving the above problem by adapting a current profile when a disparity between the magnetic force and the hydraulic force could be present.

The method begins at 510, in that a first current profile is applied to the solenoid drive of the fuel injector 1 in order to carry out a first injection process and thereby inject a predetermined injection quantity. The first current profile is chosen such that an injection of the predetermined injection quantity is to be expected under normal (or expected) circumstances, in particular in the case of a normal (or an already known, reduced) fuel pressure.

A first value of a parameter PW is now ascertained at 520. This value is indicative of the velocity of the armature when hydraulically stopped (and thus also of the width of the gap between the armature 4 and the pole piece 6, since the velocity is higher the smaller the gap), and may be based in particular on a feedback signal for determining the opening temporal point (OPP2) for the fuel injector.

At 530, it is then determined whether the first value of the parameter PW is greater than a first (upper) threshold value S1, such that a disparity between a magnetic force in the direction of the pole piece 6 that is exerted on the armature 4 and an opposing hydraulic force that is exerted by the fuel on the armature 4 exists in the sense that the magnetic force is excessive.

If it is determined at 530 that PW>S1 (YES), an impingement of the solenoid drive of the fuel injector 1 takes place with an adapted (second) current profile at 535, so as to carry out a second injection procedure. The second current profile, in comparison with the first current profile, is specified such that the magnetic force that is exerted on the armature 4 in the direction of the pole piece 6 is lower than on use of the first current profile. This can be achieved in particular by predefining a smaller peak current value and/or a smaller holding current value and/or a lower voltage.

If it is determined at 530 that the first value of the parameter PW is not greater than the threshold value S1 (NO), it is determined at 540 whether the first value of the parameter PW is smaller than a second (lower) threshold value S2. If this is the case, a disparity between the magnetic force in the direction of the pole piece 6 that is exerted on the armature 4 and the opposing hydraulic force that is exerted by the fuel on the armature 4 exists in the sense that the magnetic force is excessively low.

If it is determined at 540 that PW<S2 (YES), an impingement of the solenoid drive of the fuel injector 1 takes place with an adapted (second) current profile at 535, so as to carry out a second injection procedure. The second current profile, in comparison with the first current profile, is specified such that the magnetic force in the direction of the pole piece 6 that is exerted on the armature 4 is greater than in the use of the first current profile. This can be achieved in particular by predefining a larger peak current value and/or a larger holding current value and/or a higher voltage.

After the impingement with the second current profile at 535, a corresponding (second) value of the parameter PW is ascertained at 520, and the steps 530, 535, 540 described above are carried out using said second value. This loop is repeated until the value of the parameter PW last determined is situated between the two threshold values S1 and S2, that is to say until S1>PW>S2.

If it is determined at 540 that the first value of the parameter PW is not smaller than the threshold value S1 (NO), the method then ends at 550. Once the disparity has thus been eliminated, the injected fuel quantity may if required be adjusted more accurately using closed-loop control methods known per se, such as, for example, adapting an actuation time as a function of detected opening and/or closing times.

Figure 6:
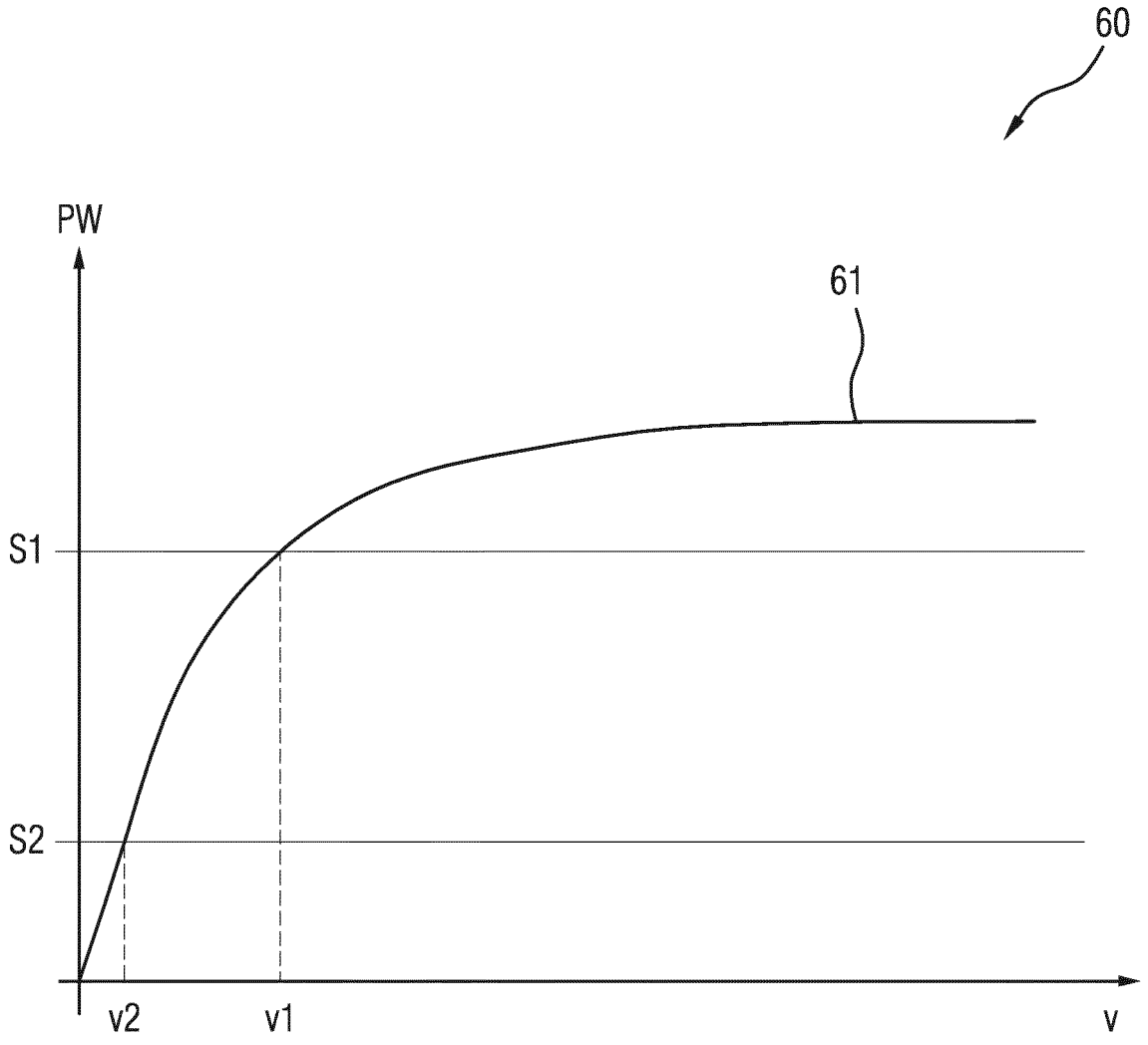
FIG. 6 shows an illustration of a correlation between the armature velocity and the parameter value, said correlation incorporating teachings of the present disclosure.

FIG. 6 shows an illustration 60 of a correlation between the armature velocity v when stopped and the parameter value PW. More specifically, the illustration shows said correlation as a curve 61. As can be derived from the curve 61, the value of the parameter PW increases at an increasing stopping velocity v, wherein the curve 61 at comparatively high stopping velocities however becomes almost flat. The depiction also shows the threshold values S1 and S2, which have been explained in the context of FIG. 5, wherein the upper threshold value S1 corresponds to the maximum stopping velocity v1 at which the fuel injector 1 functions as envisaged (by way of a sufficient gap width), and the lower threshold value S2 corresponds to the minimum stop velocity v2 at which the fuel injector 1 functions as envisaged (by way of a sufficient gap width).

The described method can be implemented directly in an engine control unit, for example as a software module. As described above, such an engine control unit enables a stable operation of the engine (in the case of a "low-pressure limp home" having been identified). Furthermore, misfires at a very low fuel pressure can be avoided.

LIST OF REFERENCE SIGNS

1 Fuel injector
2 Housing
3 Coil
4 Armature
5 Nozzle needle
6 Pole piece
7 Calibration spring
8 Valve seat
9 Injection bore
10 Gap
11 Fuel flow
30 Diagram
31-32 Voltage pulse
35 Current strength
IP Peak current
U1 Booster voltage
IH Holding current
t Time
Diagram
41-42 Injection rate profile
Q Injection rate
500 Flowchart
510-550 Method step
560 Diagram
61 Curve
PW Parameter value
v Stopping velocity
S1-S2 Upper and Lower threshold value
v1 Maximum stopping velocity
v2 Minimum stopping velocity

What is claimed is:

1. A method for operating a fuel injector having an hydraulic stop, wherein the fuel injector includes a solenoid drive and a pole piece, wherein the solenoid drive has a movable armature and a nozzle needle movable by way of the armature, the method comprising:

applying a first current profile to the solenoid drive to carry out a first injection procedure and inject a predetermined injection quantity;

ascertaining a first value of a parameter correlating to a velocity of the armature when reaching the hydraulic stop;

determining whether the first value of the parameter is greater than a first threshold value; and if the first value of the parameter is greater than the first threshold value, applying a second current profile to the solenoid drive to carry out a second injection procedure;

wherein the second current profile in comparison with the first current profile exerts a lower magnetic force in the direction of the pole piece on the armature.

2. The method as claimed in claim 1, wherein ascertaining the first value of the parameter includes analysing a feedback signal for determining an opening temporal point for the fuel injector.

3. The method as claimed in claim 1, wherein:

the first current profile has a first peak current value;

the second current profile has a second peak current value; and the second peak current value is smaller than the first peak current value.

4. The method as claimed in claim 1, wherein:

the first current profile has a first holding current value;

the second current profile has a second holding current value; and the second holding current value is smaller than the first holding current value.

5. The method as claimed in claim 1, wherein:

the first current profile is applied by a first voltage pulse;

the second voltage profile is applied by a second voltage pulse; and the second current pulse has a lower voltage than the first voltage pulse.

6. The method as claimed in claim 1, further comprising:

if the first value of the parameter is not greater than the first threshold value, determining whether the first value of the parameter is smaller than a second threshold value; and if the first value of the parameter is smaller than the second threshold value, applying a second current profile to the solenoid drive to carry out a second injection procedure;

wherein the second current profile in comparison with the first current profile applies a greater magnetic force in the direction of the pole piece on the armature.

7. The method as claimed in claim 1, further comprising:

ascertaining a second value of the parameter;

determining whether the second value of the parameter is greater than the first threshold value; and if the second value of the parameter is greater than the first threshold value, applying a third current profile to the solenoid drive to carry out a third injection procedure;

wherein the third current profile in comparison with the second current profile applies a lower magnetic force in the direction of the pole piece on the armature.

8. The method as claimed in claim 7, further comprising:

if the second value of the parameter is not greater than the first threshold value, determining whether the second value of the parameter is smaller than a second threshold value; and if the second value of the parameter is smaller than the second threshold value, applying a third current profile to the solenoid drive to carry out a third injection procedure;

wherein the third current profile in comparison with the second current profile exerts a greater magnetic force in the direction of the pole piece on the armature.

9. An engine control unit for a vehicle, engine control unit comprising:

a processor; and a memory storing a set of instructions, the set of instructions, when loaded and executed by the processor, causing the processor to:

apply a first current profile to a solenoid drive of a fuel injector to carry out a first injection procedure and inject a predetermined injection quantity;

ascertain a first value of a parameter correlating to a velocity of an armature of the fuel injector when reaching a hydraulic stop of the armature;

determining whether the first value of the parameter is greater than a first threshold value; and if the first value of the parameter is greater than the first threshold value, applying a second current profile to the solenoid drive to carry out a second injection procedure;

wherein the second current profile in comparison with the first current profile exerts a lower magnetic force in the direction of a pole piece on the armature.

10. A computer program comprising a set of instructions stored on a non-transitory medium, the set of instructions, when loaded and executed by the processor, causing the processor to:

apply a first current profile to a solenoid drive of a fuel injector to carry out a first injection procedure and inject a predetermined injection quantity;

ascertain a first value of a parameter correlating to a velocity of an armature of the fuel injector when reaching a hydraulic stop of the armature;

determining whether the first value of the parameter is greater than a first threshold value; and if the first value of the parameter is greater than the first threshold value, applying a second current profile to the solenoid drive to carry out a second injection procedure;

wherein the second current profile in comparison with the first current profile exerts a lower magnetic force in the direction of a pole piece on the armature.

* * * * *